US005633619A

United States Patent [19]

Oetjen et al.

[11] Patent Number: 5,633,619

[45] Date of Patent: May 27, 1997

[54] INTERLOCK ASSEMBLY FOR A FUSIBLE SWITCH HAVING AN OPERATING MECHANISM

[75] Inventors: Calvin L. Oetjen; Gordon O. Perkins, both of Murfreesboro; Antanas V. Narusevicius, Brentwood, all of Tenn.

[73] Assignee: Square D Company, Palatine, Ill.

[21] Appl. No.: 461,347

[22] Filed: Jun. 5, 1995

[51] Int. Cl.[6] ..... H01H 71/20

[52] U.S. Cl. ..... 337/143; 337/6; 337/174; 337/241; 337/210

[58] Field of Search ..... 337/4, 6, 8, 7, 337/142–147, 174, 210, 225, 241, 156

[56] References Cited

U.S. PATENT DOCUMENTS 3,842,380 10/1974 Granson et al. ..... 337/6

*Primary Examiner*—Leo P. Picard
*Assistant Examiner*—Jayprakash N. Gandhi
*Attorney, Agent, or Firm*—Larry I. Golden; Kareem M. Irfan; Wayne H. Stoppelmoor

[57] ABSTRACT

An interlock assembly is provided for a fusible switch which has a fuse in series with a switch and an operating mechanism for controlling the operation of the switch. The interlock assembly is mechanically coupled to the operating mechanism and includes an indicator member disposed adjacent to the fuse for indicating the status of the fuse and an actuator member mechanically coupled to the operating mechanism for actuating the operating mechanism to open the switch when the fuse is BLOWN. A toggle member is coupled to the indicator member and to the actuator member for mechanically communicating the status of the fuse to the actuator member from the indicator member wherein the toggle member is in one position when the fuse is CONDUCTIVE and the toggle member is in another position when the fuse is BLOWN.

18 Claims, 6 Drawing Sheets

INTERLOCK ASSEMBLY FOR A FUSIBLE SWITCH HAVING AN OPERATING MECHANISM

FIELD OF THE INVENTION

This invention relates generally to electrical switching equipment having fuses and, more specifically, to an interlock assembly for actuating the opening of a switch after a fuse blows and preventing the reclosure of the switch until the fuse is replaced.

BACKGROUND OF THE INVENTION

Fusible switches having a fuse and a current carrying blade utilize externally powered devices, such as relays or solenoids, to actuate the opening of the blade when the fuse blows due to an overload or short circuit condition. A problem could arise if the external power became unavailable when it was needed to operate the relay or solenoid for actuating the opening of the switch. Therefore, there is a distinct need to provide an assembly which utilizes only mechanical components to actuate the opening of the switch.

The use of interlocks to prevent closing the blade in a fusible switch after its fuse has blown is shown in German pat. no. DE 31 12295 A1. However, interlocks in the prior art only prevent closure of the phase that the fuse and switch are associated with. A need therefore exists for utilizing an interlock assembly for preventing closure of all three phases in a three phase fusible switch. Additionally, some interlock assemblies in the prior art require electrical power to operate external devices, such as solenoids and relays, for preventing the blade of the switch from being closed after the fuse has blown. Therefore, there is a need to provide an interlock assembly that does not require external power to prevent the switch from closing.

Additionally, when a fuse in a single phase of a multiphase fusible switch blows and the other phases continue to conduct electrical current, a single phase condition exists that may damage the electrical equipment that is downstream from the switch. Accordingly, in order to prevent a single phase condition, there is a need for providing an interlock assembly for actuating the opening of all of the phases in a multi-phase fusible switch in the event that any one of the fuses blow.

SUMMARY OF THE INVENTION

It is a general object of the present invention to provide a mechanical interlock assembly for a fusible switch.

It is a more specific object of the present invention to provide an interlock assembly which prevents a switch from being closed when an associated fuse has blown.

It is another object of the present invention to provide an interlock assembly which actuates the opening of a fusible switch when the fuse detects an overload or short circuit condition.

In accordance with a preferred embodiment of the present invention an interlock assembly is provided for use with a fusible switch which has a series fuse and an operating mechanism for controlling switch operation. The interlock assembly includes an indicator member disposed adjacent to the fuse for indicating the status of the fuse, and an actuator member coupled to the operating mechanism for actuating thereof to open the switch when the fuse is BLOWN. A toggle member coupled to both the indicator member and to the actuator member communicates the fuse status to the actuator member. The toggle member is disposed to be in a first position when the fuse is CONDUCTIVE and in a second position when the fuse is BLOWN.

BRIEF DESCRIPTION OF THE DRAWINGS

Other objects and advantages of the invention will be apparent from the following detailed description and the accompanying drawings in which.

DETAILED DESCRIPTION OF THE PREFERRED EMBODIMENTS

For a better understanding of the present invention together with other and further advantages, and capabilities thereof, reference is made to the following disclosure and appended claims in connection with the above-described drawings.

Figure 1:
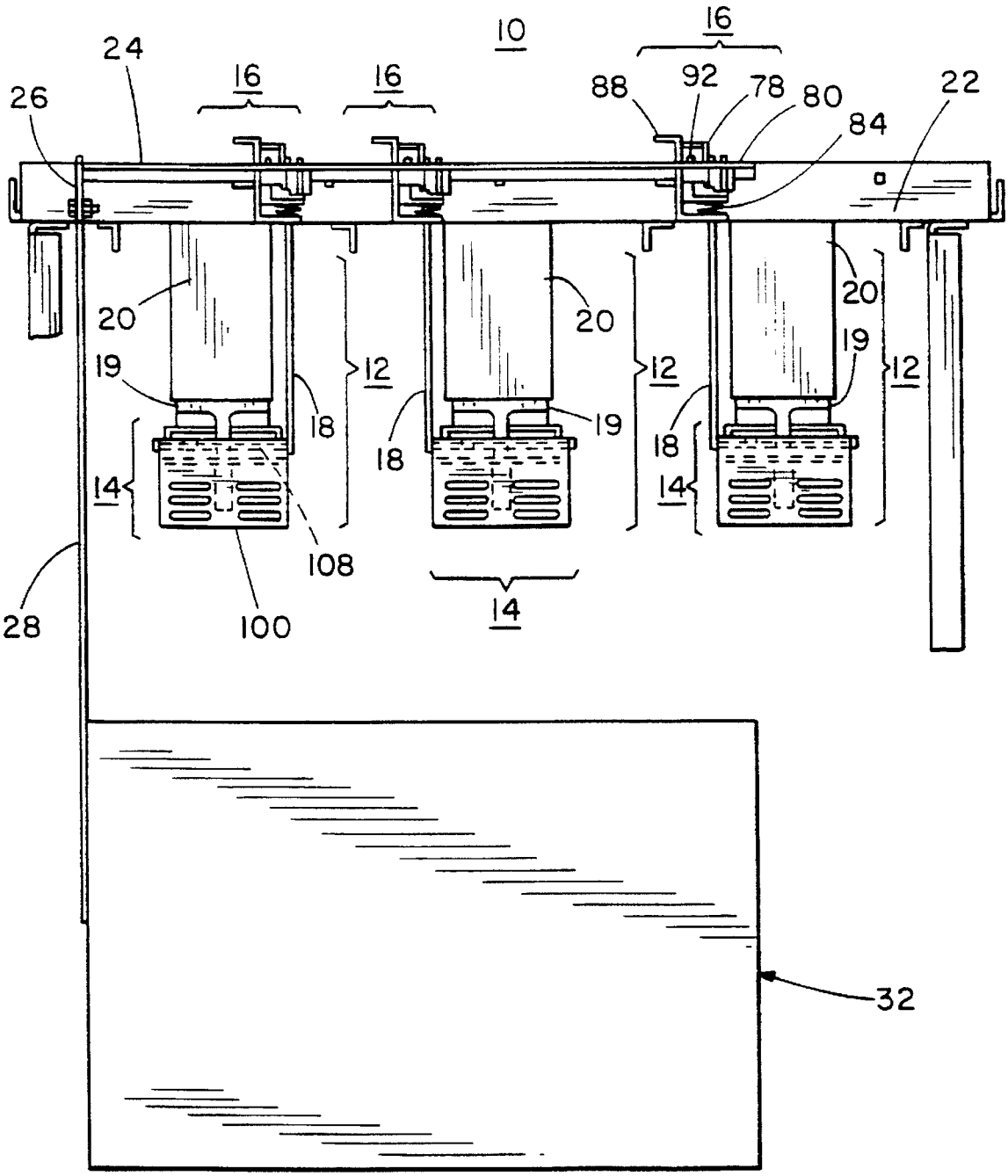
FIG. 1 is a partial perspective view of a three phase fusible switch including an interlock assembly according to the present invention.

As shown in FIG. 1, a three phase switch 10 (partially shown) includes an interlock assembly 12 corresponding to each of its three phases. As shown, each interlock assembly 12 includes an indicator assembly 14 to which an actuator assembly 16 is coupled by a toggle shaft 18. The indicator assembly 14 is secured to an interconnect terminal 19 which is secured to one end of an insulator 20, the other end of which is secured to an end wall 22. The actuator assembly 16 is mounted to the switch wall 22 and has a cover (not shown). All of the three actuator assemblies 16 corresponding to the three interlock assemblies are coupled together with a rotatable cross bar 24 so that all three phases may be simultaneously actuated. Hence, all phases of the switch are opened in response to a blown fuse indication from the indicator assembly 14 for any of the three phases. An end lever 26 is welded to the end of the cross bar 24 and is pivotally coupled to a trip release rod 28. As the cross bar 24 rotates, the end lever 26 translates the rotational movement of the cross bar 24 to horizontal movement of the trip release rod 28. This horizontal movement of the trip release rod 28 actuates an operating mechanism 32 through a trip lever 34 (shown in FIG. 2) and will be discussed in more detail hereinafter. The operating mechanism 32 is utilized to simultaneously open or close all three phases of the switch.

Figure 2:
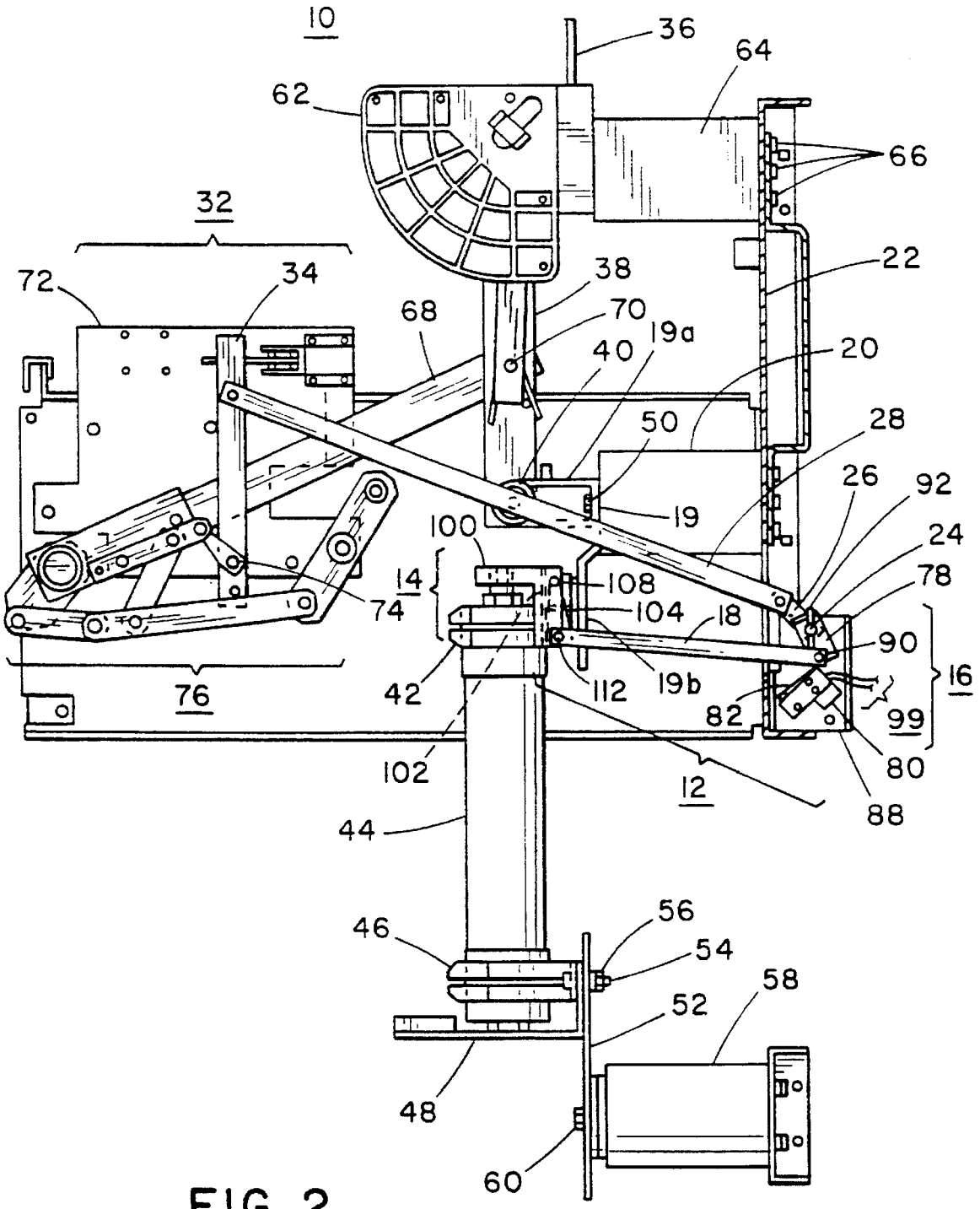
FIG. 2 is a side view of the three phase fusible switch shown in FIG. 1, showing a single phase of the three phase switch with a CONDUCTIVE fuse and a blade in a CLOSED position.

FIG. 2 shows a side view of a single phase of the switch 10 and the operating mechanism 32. Each phase of the switch 10 includes the interlock assembly 12 and a current path defined by a line or input terminal 36, a blade 38, the interconnect terminal 19, a fuse 44 and a load or output terminal 48. The fuse 44 is disposed with one end secured in a fuse clip 42 attached to the interconnect terminal 19. The other end of the fuse 44 is secured in a second fuse clip 46. The blade 38 is rotatably coupled about a blade pivot 40 at one end and when rotated into a CLOSED position, it is electrically coupling at its other end to the line terminal 36. Thus, current flows through the terminal 19 when the switch 10 is in the CLOSED position and the fuse 44 is CONDUCTIVE. When the blade 38 is rotated about the pivot 40 into an OPEN position wherein the end of the blade 38 is not electrically coupled to the line terminal 36, current flowing through the current path is interrupted. The blade pivot 40 is secured to a top portion 19*a* of the interconnect terminal 19 and the fuse clip 42 is secured to a bottom portion 19*b* of the interconnect terminal. The interconnect terminal 19 is secured to the insulator 20 with a bolt 50. The second fuse clip 46 is secured to the output terminal 48 and a mounting bracket 52 with a bolt 54 and a nut 56. The mounting bracket 52 is secured to an insulator 58 with a bolt 60.

As shown in FIG. 2, the blade 38 and the fuse 44 are placed in series with one another. When either the blade 38 is moved into the OPEN position or the fuse 44 BLOWS, caused by a short circuit or an overload condition, current flow through the switch is interrupted. The fuse 44 has an indicator pin 61 which extends outwardly when the fuse 44 BLOWS thereby indicating the status of the fuse 44 and initiating the movement of the blade into the OPEN position, as will be discussed below.

Each phase of the switch 10 further includes an arc chute 62 which may, for example, be similar to the arc chute described in U.S. Pat. No. 4,362,915 entitled "Electrical Arc Confining Device" which is assigned to the same assignee as the present application and the disclosure therein is incorporated herein by reference. The input terminal 36 and the arc chute 62 are secured to an insulator 64 which is secured to the end wall 22 with a set of bolts 66. Insulators 20, 58, and 64 are made of insulating material to insulate the end wall 22 from the current path.

Figure 7:
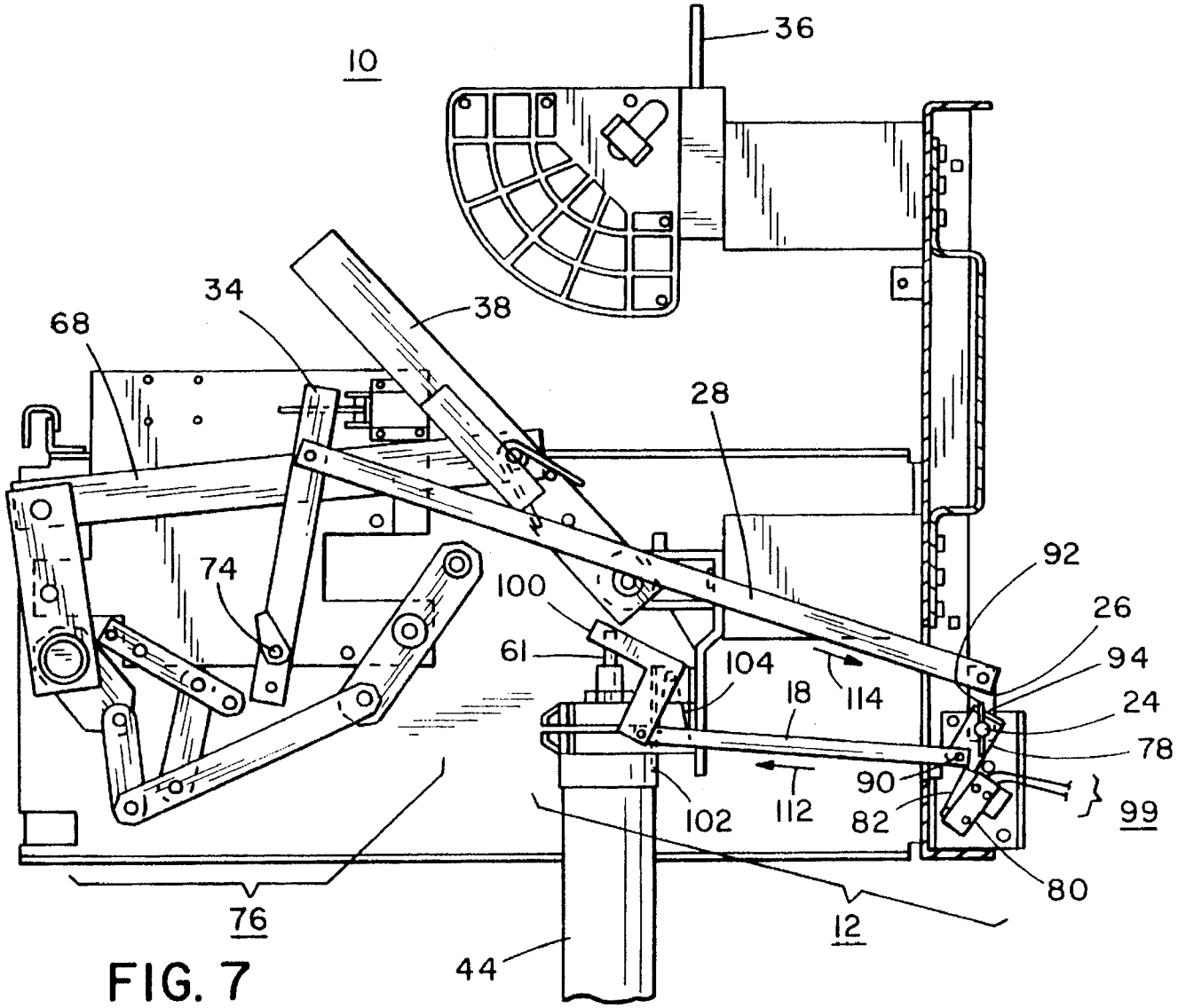
FIG. 7 is a side view of the three phase fusible switch shown in FIG. 1, showing a single phase of the three phase switch with a BLOWN fuse and the blade in an OPEN position.
Figure 8:
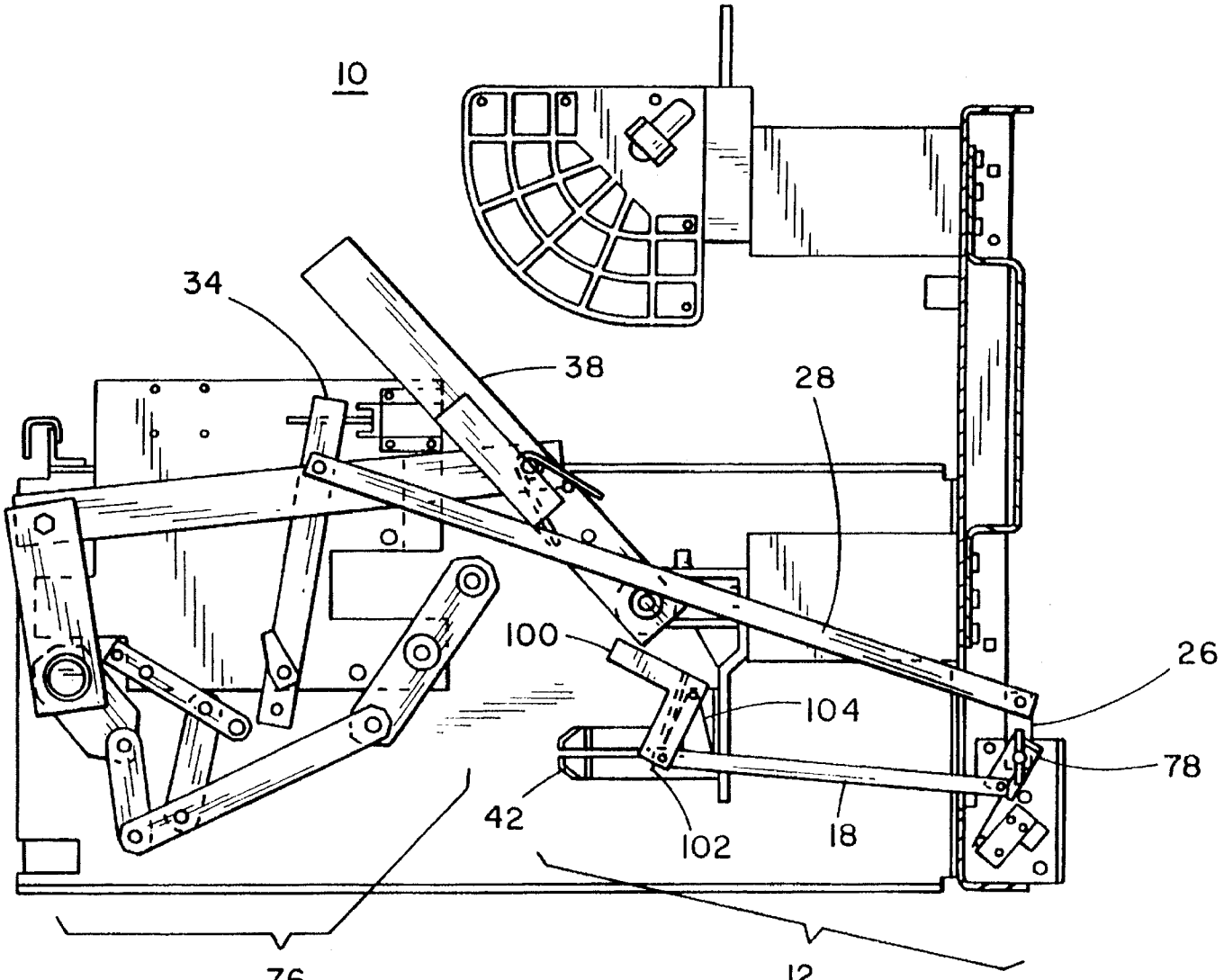
FIG. 8 is a side view of the three phase fusible switch shown in FIG. 1, showing a single phase of the three phase switch without the fuse and having the blade in the OPEN position.

Any conventional trippable operating mechanism having means, such as the trip lever 34, for interfacing with the interlock assembly 12 may be used with the present invention. According to a preferred embodiment, the operating mechanism 32 is shown including a toggle link 68 coupled to the blade 38 with a pivot pin 70. The link toggles the blade 38 between the CLOSED position and the OPEN position. Current flows through the current path when the blade 38 is in the CLOSED position and the fuse 44 is present and not BLOWN. Current flow is prohibited when the blade 38 is in the OPEN position or the fuse 44 is absent or BLOWN. The trip lever 34 is pivotally coupled to a frame 72 through a pivot pin 74 for actuating the operating mechanism 32 to move the blade 38 from the CLOSED position to the OPEN position. A collapsible linkage assembly 76 is coupled to the trip lever 34 to force the blade 38 into the CLOSED position (as shown in FIG. 2); the assembly 76 collapses into a non-forcible position when the trip lever 34 is in a TRIP position (as shown in FIGS. 7 & 8) thereby forcing the toggle link 68 to move the blade 38 into the OPEN position.

The trip release rod 28 mechanically couples the trip lever 34 to the interlock assembly 12 for moving the trip lever 34 into the TRIP position thereby collapsing the collapsible linkage assembly 76 and moving the toggle link 68 and the blade 38 into the OPEN position.

Figure 3:
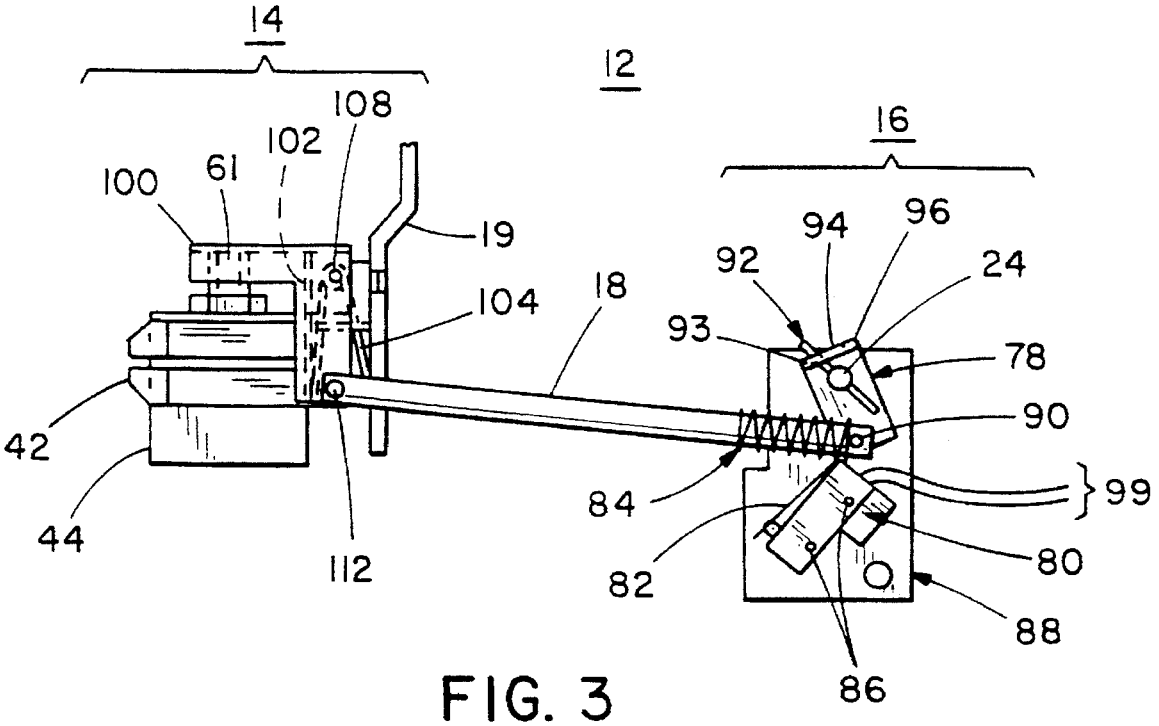
FIG. 3 is a perspective view of an interlock assembly having an indicator assembly and an actuator assembly in accordance with the preferred embodiment of the present invention.
Figure 4:
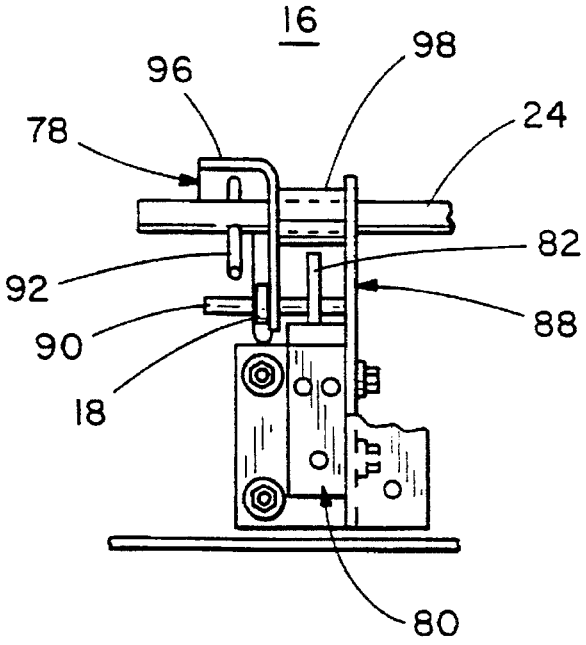
FIG. 4 is a perspective end view of the actuator assembly shown in FIG. 3.

As shown in FIGS. 3 & 4, the actuator assembly 16 includes a lever 78, a micro-switch 80 having an actuator arm 82, and a compression spring 84. A set of screws 86 secure the micro-switch 80 to a bracket 88 which is secured to the wall 22 of the three phase switch 10. The lever 78 having the cross bar passing therethrough and rotates thereabout is pivotally coupled to the toggle shaft 18 with a pivot pin 90 at one end. A roll pin 92 extends through the cross bar and cooperates with an edge 93 of a slot 94 in a flange 96 extending from the other end of the lever 78. A sleeve 98 is positioned between the lever 78 and the bracket 88 surrounding the cross bar 24. When the fuse 44 blows, the indicator assembly 14 toggles the toggle shaft 18 in a horizontal direction which causes the lever 78 to rotate around the cross bar 24. As the lever 78 rotates around the cross bar 24 the edge 93 of the slot 94 forces the cross bar 24 to rotate.

The cross bar 24 couples the levers of each actuator assembly of each phase of the three phase switch 10 to the trip release rod 28 (FIG. 2) thereby allowing any one of the phases to actuate the opening of the blade 38 (FIG. 2). The slot 94 in the lever 78 serves an important function; when a fuse blows in one phase causing the cross bar 24 and thus the roll pin 92 to rotate, the roll pin traverses in the slot 94 and does not affect the position of the lever 78 in the phases that do not have a BLOWN fuse.

The micro-switch 80 can be electrically coupled to external devices or alarms, such as indicator lights, bells and horns, for indicating the condition of the fuse. A pair of wires 99 are electrically coupled to the micro-switch 80 for communicating the status, either CONDUCTIVE, BLOWN or MISSING, of the fuse 44 to the external devices.

Figure 5:
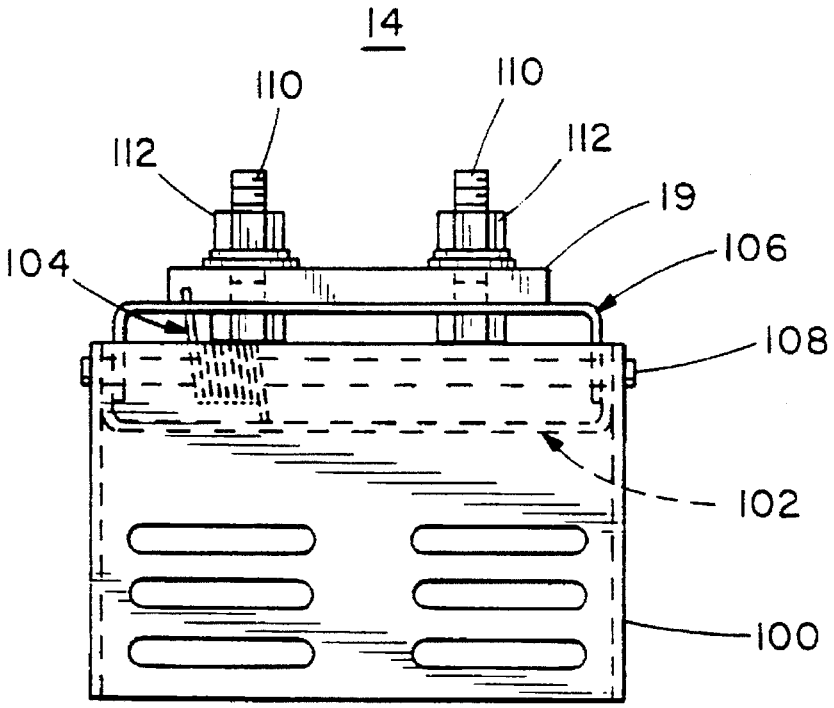
FIG. 5 is a perspective top view of the indicator assembly shown in FIG. 3.
Figure 6:
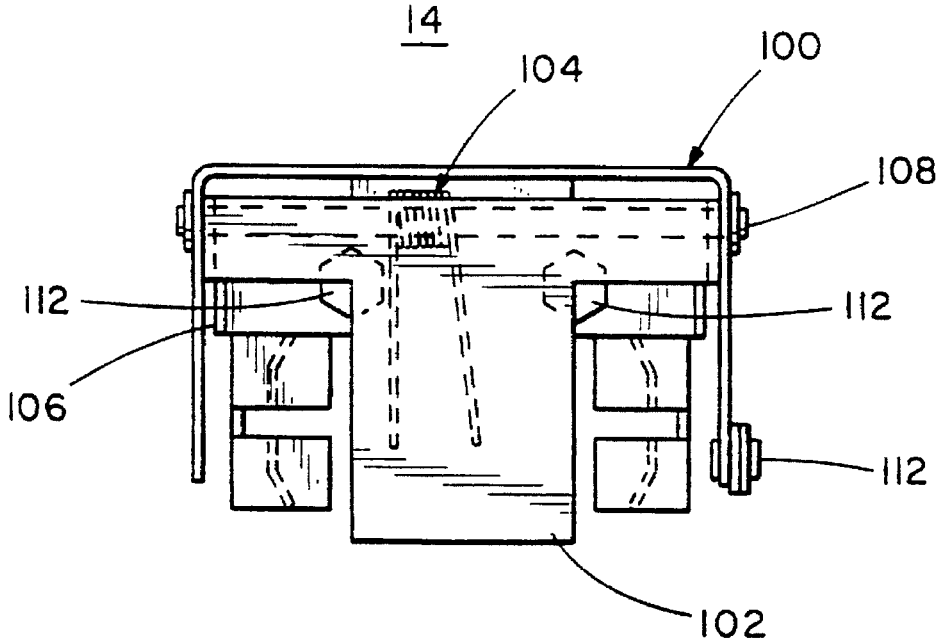
FIG. 6 is a perspective front view of the indicator assembly shown in FIG. 3.

As shown in FIGS. 3, 5 & 6 the indicator assembly 14 includes an indicator flap 100, a missing fuse flap 102, a torsion spring 104, a mounting bracket 106, and a pivot pin 108. The indicator flap 100, the missing fuse flap 102 and the mounting bracket 106 are coupled to the pivot pin 108. The pivot pin 108 passes through each side of the indicator flap 100 and the missing fuse flap 102 thereby allowing them to rotate. The torsion spring 104 surrounds the pivot pin 108 and has one end engaging the mounting bracket 106 and its other end engaging the missing fuse flap 102 thereby biasing the flap into the fuse 44 in an unextended position (as shown in FIG. 2) when the fuse is present. When the fuse is missing, the torsion spring 104 biases the flap 102 outwardly into a "missing fuse" or actuated position (as shown in FIG. 8). Bolts 110 and nuts 112 secure the mounting bracket 106 to the interconnect terminal 19. The indicator flap 100 is rotatably coupled to the toggle shaft 18 with a pivot pin 112 thereby coupling the indicator assembly 14 to the actuator assembly 16.

Rotational movement of the indicator flap 100 is translated into horizontal movement of the toggle shaft 18. This toggles the actuator assembly 16 and actuates the operating mechanism 32 to move the blade 38 from the CLOSED position to the OPEN position.

As shown in FIGS. 1 & 3, the compression spring 84 has one of its ends resting against the pivot pin 90 and its other end resting against the switch wall 22. The spring biases the pivot pin 90 into the actuator arm 82 and compressing it, thereby turning the micro-switch 80 ON when the fuse 44 is CONDUCTIVE. As will be described below, the micro-switch 80 is turned OFF when the fuse is BLOWN or absent. Although the use of the spring 84 is shown and described above, its use is not required because the weight of the indicator flap 100 uses gravity to bias the toggle shaft 18 into the position shown in FIG. 3.

The operation of the interlock assembly 12 will now be discussed. FIG. 2 shows the blade 38 in the CLOSED position, the fuse 44 CONDUCTIVE and the micro-switch 80 in the ON position. As shown in FIG. 7, when the fuse 44 detects an overcurrent or a short circuit condition it will BLOW causing the extender pin 61 to extend outwardly forcing the indicator flap 100 to rotate clockwise. The clockwise rotation of the indicator flap 100 pulls the toggle shaft 18 horizontally in the direction of direction arrow 112 causing the lever 78 to rotate clockwise. As the lever 78 rotates clockwise the roll pin 92 engages an end of the slot 94 thereby causing the cross bar 24 to rotate clockwise. The clockwise rotation of the cross bar 24 causes the end lever 26 to rotate clockwise. The clockwise rotation of the end lever 26 causes the trip release rod 28 to translate in the direction of direction arrow 114 which causes the trip lever 34 to rotate clockwise about the pivot pin 74 into the TRIP position shown in the figure. Moving the trip lever 34 into the TRIP position causes the linkage assembly 76 to collapse thereby forcing the toggle link 68 to pull the blade 38 away from engagement with the input terminal 36 and into the OPEN position. Because the operating mechanism 32 controls all of the phases of the switch 10, this action causes the operating mechanism 32 to move the blades of each phase to the OPEN position.

As the toggle shaft 18 moves in the direction of direction arrow 112, the pivot pin 90 is pulled away from the micro-switch actuator arm 82 thereby allowing it to move to its non-actuated position and turning the micro-switch 80 OFF. This action indicates to external devices (not shown) that the fuse 44 has BLOWN.

Until the BLOWN fuse is replaced with a good or CONDUCTIVE fuse, which has its extender pin 61 recessed therein, the blade 38 is prevented from being moved into the CLOSED position because the extender pin 61 holds the interlock assembly 12 in the actuated position shown in FIG. 7. With the extender pin 61 extended, the indicator flap 100 remains rotated clockwise which holds the toggle shaft 18 in the toggled position thereby holding the lever 78 in the clockwise position. With the trip lever 78 in the clockwise position, the trip release rod 38 is held in the position shown in FIG. 7 thereby holding the trip lever 34 in the clockwise or TRIP position. With the trip lever 34 in the TRIP position the linkage assembly 76 remains collapsed and can not move the blade 38 into the CLOSED position.

FIG. 8 shows that the blade 38 is prevented from being moved into the CLOSED position when the fuse is not present. As shown in FIGS. 2 and 7 the missing fuse flap 102 is biased into engagement with a side of the fuse 44 by the torsion spring 104. However, as shown in FIG. 8, when the fuse is missing the torsion spring 104 forces the missing fuse flap 102 to rotate outwardly in the clockwise direction into the area where the fuse would normally be located. The clockwise rotation of the missing fuse flap 102 causes the indicator flap 100 to rotate clockwise into the actuated position thereby holding the trip lever 34 in the TRIP position and preventing the blade 38 from being CLOSED, as previously described.

An exemplary fuse that may be used for the fuse 44 is available as part no. AO55F-1DSR0-200E from Square D Company of Palatine, Ill. The extender pin 61 is an integral part of the fuse and extends outwardly when the fuse blows caused by a short circuit or overcurrent condition in the circuit it is protecting.

The micro-switch 80 is available as part no. MT-4RV-A28 from Honeywell of Minneapolis, Minn.

While there have been shown and described what are at present considered the preferred embodiments of the invention, it will be obvious to those skilled in the art that various changes and modifications may be made therein without departing from the scope of the invention as defined by the appended claims.

What is claimed is:

1. A fusible switch comprising:

a blade capable of conducting current;

a fuse electrically coupled in series with said blade and including an extender member therein which extends outwardly when said fuse blows due to an overload condition or a short circuit condition;

an operating mechanism coupled to said blade for moving said blade between an OPEN position wherein the blade does not conduct current therethrough and a CLOSED position wherein the blade conducts current therethrough; and an interlock assembly coupled to said operating mechanism for actuating the operating mechanism to move said blade from the CLOSED position to the OPEN position when the extender member is extended outwardly in response to either an overload condition or a short circuit condition.

2. A switch according to claim 1, wherein said interlock assembly further actuates the operating mechanism to prohibit the blade from being moved from the OPEN position to the CLOSED position when the extender member is extending outwardly from the fuse.

3. A switch according to claim 2, wherein said interlock assembly further actuates the operating mechanism to prohibit the blade from being moved from the OPEN position to the CLOSED position when the fuse is absent.

4. A switch according to claim 1, wherein said interlock assembly includes:

an indicator member disposed adjacent to the fuse for indicating the status of the fuse;

an actuator member mechanically coupled to the operating mechanism for actuating the operating mechanism to open the switch when the fuse is BLOWN; and a toggle member coupled to said indicator member and to said actuator member for mechanically communicating the status of the fuse to said actuator member from said indicator member wherein said toggle member is in one position when the fuse is conductive and said toggle member is in another position when the fuse is BLOWN.

5. A switch according to claim 4 further including an electrical switch having an actuator arm which cooperates with said toggle member for electrically communicating the status of the fuse to external devices.

6. A switch according to claim 4 further including a trip lever coupled to said operating mechanism and to said actuator member for interfacing said interlock assembly to said operating mechanism.

7. An interlock assembly for a fusible switch having a fuse in series with a switch and an operating mechanism for controlling the operation of the switch, the fuse is CONDUCTIVE when it allows current to flow therethrough and is BLOWN when it does not allow current to flow therethrough, said interlock assembly comprising:

an indicator member for indicating the status of the fuse;

an actuator member coupled to the operating mechanism for actuating the operating mechanism to open the switch when the fuse is BLOWN; and a toggle member for communicating the status of the fuse to said actuator member from said indicator member, wherein said toggle member is in one position when the fuse is CONDUCTIVE and said toggle member is in another position when the fuse is BLOWN.

8. An interlock assembly according to claim 7, wherein said indicator member is disposed adjacent to the fuse.

9. An interlock assembly according to claim 7, wherein said actuator member is mechanically coupled to the operating mechanism.

10. An interlock assembly according to claim 7, wherein said toggle member is coupled to said indicator member and to said actuator member.

11. An interlock assembly for a fusible switch having a fuse in series with a switch and an operating mechanism for controlling the operation of the switch wherein said interlock assembly is mechanically coupled to the operating mechanism, said interlock assembly comprising:

an indicator member disposed adjacent to the fuse;

an actuator member mechanically coupled to said indicator member and to the operating mechanism for actuating the operating mechanism to prevent the switch from closing when the fuse is absent or has blown.

12. An interlock assembly according to claim 11, further having a toggle member coupled to said indicator member and to said actuator member.

13. A fusible switch comprising:

a current path which includes a blade and a fuse wherein said fuse is electrically coupled in series with said blade, said fuse having an extender pin therein which extends outwardly when said fuse blows due to an overload condition or a short circuit condition;

an operating mechanism coupled to said blade for moving said blade between an OPEN position and a CLOSED position, wherein said blade conducts current therethrough when it is in the CLOSED position and does not conduct current therethrough when it is in the OPEN position; and an interlock assembly coupled to said operating mechanism for actuating the operating mechanism into moving said blade from the CLOSED position to the OPEN position when the extender pin extends indicating that said fuse has encountered either an overload condition or a short circuit condition.

14. A switch according to claim 13, wherein said interlock assembly further actuates the operating mechanism to prohibit the blade from being moved from the OPEN position to the CLOSED position when the extender pin is extending outwardly from the fuse.

15. A switch according to claim 14, wherein said interlock assembly further actuates the operating mechanism to prohibit the blade from being moved from the OPEN position to the CLOSED position when the fuse is absent.

16. A switch according to claim 13, wherein said interlock assembly includes:

an indicator member disposed adjacent to the fuse for indicating the status of the fuse;

an actuator member mechanically coupled to the operating mechanism for actuating the operating mechanism to open the switch when the fuse is BLOWN; and a toggle member coupled to said indicator member and to said actuator member for mechanically communicating the status of the fuse to said actuator member from said indicator member wherein said toggle member is in one position when the fuse is conductive and said toggle member is in another position when the fuse is BLOWN.

17. A switch according to claim 16 further including an electrical switch having an actuator arm which cooperates with said toggle member for electrically communicating the status of the fuse to external devices.

18. A switch according to claim 16 further including a trip lever coupled to said operating mechanism and to said actuator member for interfacing said interlock assembly to said operating mechanism.

* * * * *